US008465205B2

(12) United States Patent
Chen

(10) Patent No.: US 8,465,205 B2
(45) Date of Patent: Jun. 18, 2013

(54) TRASH BAG

(75) Inventor: Ping Chen, Zhongshan (CN)

(73) Assignee: Grand A International Co., Inc., S. El Monte, CA (US)

( * ) Notice: Subject to any disclaimer, the term of this patent is extended or adjusted under 35 U.S.C. 154(b) by 612 days.

(21) Appl. No.: 12/395,627

(22) Filed: Feb. 28, 2009

(65) Prior Publication Data

US 2010/0220941 A1 Sep. 2, 2010

(51) Int. Cl.
*B65D 33/16* (2006.01)

(52) U.S. Cl.
USPC ..... 383/77

(58) Field of Classification Search
USPC ..... 383/77, 66, 203
See application file for complete search history.

(56) References Cited

U.S. PATENT DOCUMENTS 3,140,815 A * 7/1964 Majesky ..... 383/203
3,217,971 A * 11/1965 Shvetz ..... 383/203
3,480,198 A * 11/1969 Repko ..... 383/203
3,779,139 A * 12/1973 White ..... 493/194
4,549,657 A * 10/1985 Martin ..... 383/204
4,609,107 A * 9/1986 Martin et al. ..... 383/210
4,778,283 A * 10/1988 Osborn ..... 383/71
4,787,517 A * 11/1988 Martin ..... 383/203

FOREIGN PATENT DOCUMENTS

WO WO 9008071 A1 * 7/1990
WO WO 2010081315 A1 * 7/2010

* cited by examiner

*Primary Examiner* — Jes F Pascua

(57) ABSTRACT

A trash bag includes a bag body being formed of plastic material and a tying element. The bag body includes a first bag sheet overlain with to a second bag sheet. A cavity is formed between the first and second bag sheets, and a top opening is formed along top edges of the first and second bag sheets. The tying element is impermanently integrated with the bag body. After the use of the bag body, said tying element is torn from the bag body to tie a knot around the top opening of the bag body and to seal the cavity. More specifically, the tying element includes a first tying band and a second tying band integrated with the first and second bag sheets of the bag body respectively, which forms the double-layer tying structure to enhance the tying strength of the tying element.

4 Claims, 3 Drawing Sheets

TRASH BAG

BACKGROUND

1. Field of the Invention

The present invention relates to a trash bag. More particularly, the trash bag with the double-layer tying structure for not only providing a relatively enhanced tying strength for the trash bag but also minimizing the overall manufacturing cost of the trash bag.

2. Discussion of the Related Art

Trash is a by-product and is directly linked to the human development. With the advent of large scale disposal of trash, disposable bag are a convenient and sanitary way of handling trash. The disposable bags are usually made of plastic and are used with a trash container to keep the container sanitary by preventing the trash directly contacting with the trash container. The disposable bag generally comprises two bag layers to form an open top and a closed bottom. When the disposable bag is used with the trash container, the open top of the disposable bag is folded back upon itself over the top rim of the trash container. After the disposable bag is filled with trash, the disposable bag is taken out of the trash container and is tied to seal the cavity of the disposable bag. The major problem of the disposable bag is how to ensure the open top of the disposable bag being closed tightly for preventing the trash being leaked out of the disposable bag.

A first type of disposable bag comprises two wrappers provided at two bag layers respectively at the open top, wherein the wrappers are then tied with each other to form a knot which closes the open top of the disposable bag. The problem of such wrappers is that each wrapper has a single-layer structure. Therefore, the wrappers will be easily torn off from the bag layers when the pulling force is exerted at the wrappers to form the knot. Further, the cavity of the disposable bag cannot be tightly sealed even though the wrappers are tightly tied.

A second type of disposable bag comprises a bendable metal wire to tie at the neck portion of the disposable bag. The advantage of the tying wire is that the disposable bag can be tightly closed to seal the cavity by tying the tying wire at the neck portion of the disposable bag. However, the problem of such tying wire is that the bag manufacturer must provide additional components to incorporate with the disposable bag, which will highly increase the cost of the disposable bag. In addition, the user must pull additional effort to keep the tying wire in a secure way because the disposable bag cannot be closed without the tying wire. Therefore, if the user misplaces the tying wires or unintentionally uses extra tying wire, the disposable bags will not be closed by the tying wires.

A third type of disposable bag comprises a tying band extending around the open top of the disposable bag, wherein the tying band can be pulled to tie and close the open top of the disposable bag. In order to incorporate with the tying band, the disposable bag has a channel formed at the open top for the tying band to slide along the channel. Obviously, the manufacturing cost and process of such disposable will be highly increased and complicated by adding the tying band as the additional component and by forming the channel at the open top of the disposable bag.

BRIEF SUMMARY OF THE INVENTION

The present invention overcomes the above mentioned drawbacks and limitation by configuring the trash bag with double-layer tying structure.

In accordance with the principles of the invention, a trash bag is provided which comprises a bag body being formed of plastic material and a tying element. The bag body comprises a first bag sheet overlain with a second bag sheet. A cavity is formed between the first and second bag sheets, and a top opening is formed along top edges of the first and second bag sheets. The tying element is impermanently integrated with the bag body. After the use of the bag body, said tying element is torn from the bag body to tie a knot at the neck portion of the bag body and to seal the cavity.

More specifically, the tying element comprises a first tying band and a second tying band integrated with the first and second bag sheets of the bag body respectively, which forms the double-layer tying structure to enhance the tying strength of the tying element.

The primary objective of the present invention is that the plastic trash bag with the double-layer tying structure for not only providing a relatively enhanced tying strength for the trash bag but also minimizing the overall manufacturing cost of the trash bag.

A further objective of the present invention is that the tying element is provided at the top opening of the trash bag. Therefore, the tying element not only keeps itself clean when the trash bag is used with a trash container but also can be torn off from the trash bag without taking the trash bag from the trash container.

Another objective of the present invention is that the tying element is tearably provided at the top opening of the trash bag so that the tying element can be torn off from the trash bag at the time when the trash bag needs to be closed. Therefore, the tying element will not be lost or misplaced unintentionally at any time.

Another objective of the present invention is that the first and second tying bands of the tying element are formed with the first and second bag sheets of the bag body respectively. Therefore, the double-layer structure of the tying element is structurally formed with the essential structure of the bag body.

Another objective of the present invention is that the tying element is integrated with the trash bag so that the manufacturing process and cost of the trash bag can be further simplified and reduced without additional component incorporating with the trash bag.

Another objective of the present invention is that the tying element can be separately manufactured and can be detachably attached to either top side, bottom side, or side edge of the trash bag that enables the user to make use of the tying element without the hassle of separately storing the tying element.

For a more complete understanding of the present invention with its objectives and distinctive features and advantages, reference is now made to the following specification and to the accompanying drawings.

BRIEF DESCRIPTION OF THE DRAWING(S)

DETAILED DESCRIPTION OF THE INVENTION

Figure 2:
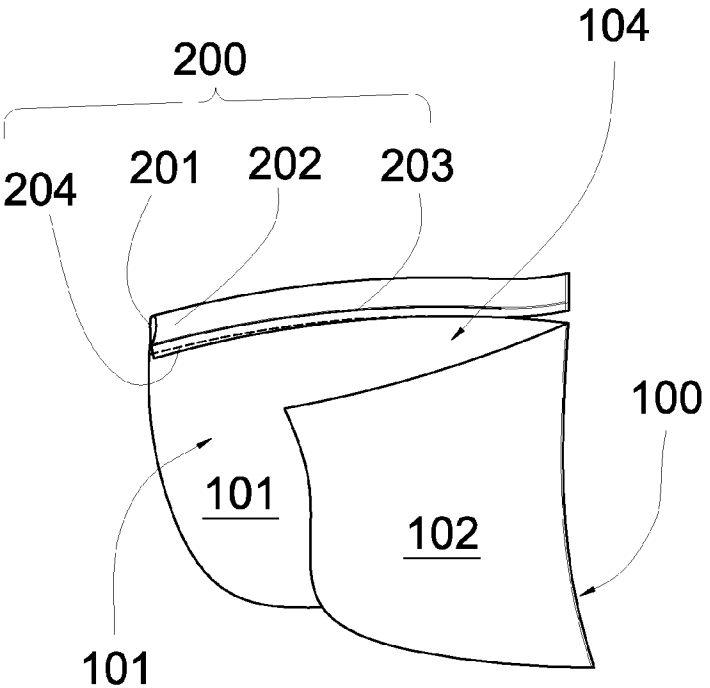
FIG. 2 is an enlarged view of the tying element of the trash bag in accordance with the present invention.
Figure 1:
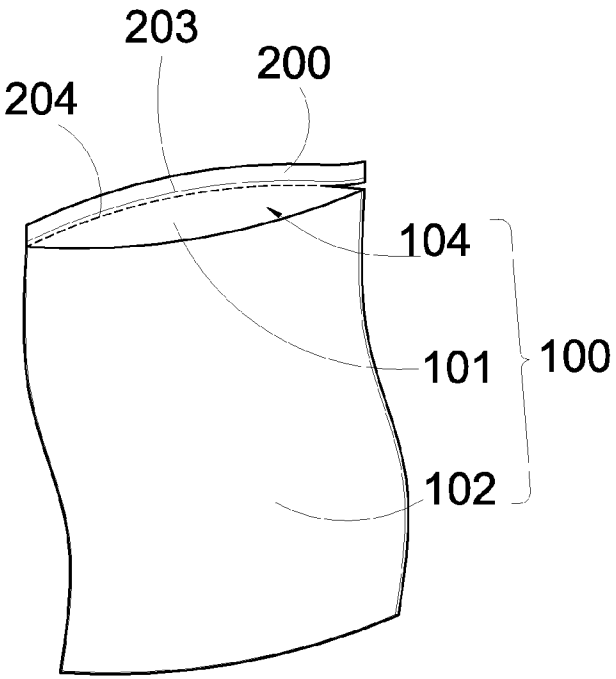
FIG. 1 is a schematic view of the trash bag in accordance with the present invention.

Referring to FIGS. 1 and 2, a plastic bag in accordance with the present invention is illustrated. The plastic trash bag comprises a bag body 100 and a tying element 200 for closing the bag body 100.

FIG. 1 illustrates the bag body 100, which is a disposable bag, has a rectangular shape wherein the bag body 100 is formed of plastic material. The bag body 100 comprises a first bag sheet 101 overlapping with a second bag sheet 102. The side edges and the bottom edge of the first bag sheet 101 are sealed and attached to the side edges and the bottom edge of the second bag sheet 102. A cavity 103 is formed between the first and second bag sheets 101 and 102. A top opening 104 is formed around the top edges of the first and second bag sheets 101 and 102.

FIG. 2 illustrates the tying element 200 being impermanently provided with the bag body 100. After the use of the bag body 100, the tying element 200 can be torn from the bag body 100 to tie a knot at the neck portion of the bag body 100 and to seal the cavity 103.

FIG. 2 also shows the tying element 200 being integrally formed along the top edge of the first bag sheet 101. Therefore, the tying element 200 is unattached to the top edge of the second bag sheet 102 to form the top opening 104. The length of the tying element 200 is not longer than the width of the bag body 100. According to FIG. 1, the length of the tying element 200 equals to the width of the bag body 100.

The purpose of this invention is to provide the tying element 200 not only being torn from the bag body 100 after the use of the bag body 100 but also with double-layer structure to enhance the strength of the tying element 200 to tie at the top opening 104 of the bag body 100.

In FIG. 2, the tying element 200, with the double-layer structure, comprises a first tying band 201 and a second tying band 202 which is identical to the first tying band 201. The top edge of the first tying band 201 is preferably integrated with the top edge of the second tying band 202, wherein the first tying band 201 is overlapped with the second tying band 202 to form the double-layer structure.

In the bag of FIG. 2, the bottom edge of the first tying band 201 is integrated with the top edge of the first bag sheet 101, wherein the bottom edge of the first tying band 201 can be torn from the top edge of the first bag sheet 101. The bottom edge of the second tying band 202 is integrated with the top edge of the second bag sheet 102, wherein the bottom edge of the second tying band 202 is torn from the top edge of the second bag sheet 102 to form the top opening 104 of the bag body 100.

Preferably, the bottom edge of the second tying band 202 is pre-cut off from the top edge of the second bag sheet 102 to form the top opening 104 of the bag body 100. However, the bottom edge of the second tying band 202 can be tearably extended along the top edge of the second bag sheet 102. Therefore, the user is able to tear off the second tying band 202 from the second bag sheet 102 to form the top opening 104 at the time the bag body 100 is used.

A sealing line 203, as a welding line, is provided along the tying element 200 to permanently seal the first tying band 201 with the second tying band 202 as in FIG. 2. The sealing line 203 is a hot sealed portion extended parallely between the top and bottom edges of the first and second tying bands 201 and 202. Preferably, the sealing line 203 is located close to the bottom edges of the first and second tying bands 201 and 202. While the top edges of the first and second tying bands 201 and 202 are formed integrally, the sealing line 203 will ensure the double-layer structure of the tying element 200 after the tying element 200 is torn off from the bag body 100.

In FIG. 2, a perforated line 204 is formed along the top edge of the first bag sheet 101, wherein the perforated line 204 is extended parallely along the bottom edge of the first tying band 201 and the top edge of the first bag sheet 101. The tying element 200 is torn along the perforated line 204 to detach the tying element 200 from the bag body 100.

Figure 3:
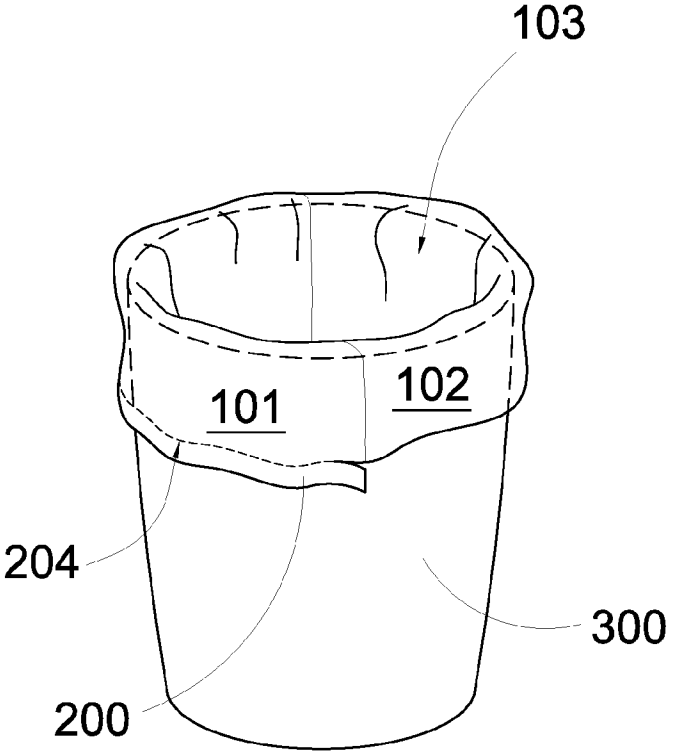
FIG. 3 is a schematic view to show the trash bag used with the trash container in accordance with the present invention.

FIG. 3 shows the trash bag of the invention being used with a trash container 300. In accordance with the invention, the bag body 100 can fit loosely within the trash container 300. It will be understood that the bag body 100 is longer in length than the trash container 300 in depth. The bottom of the bag body 100 will rest on the bottom of the trash container 300 and there will be sufficient length in the bag body 100 so that the top opening 104 of the bag body 100 can be folded over the top of the trash container 300.

Figure 4:
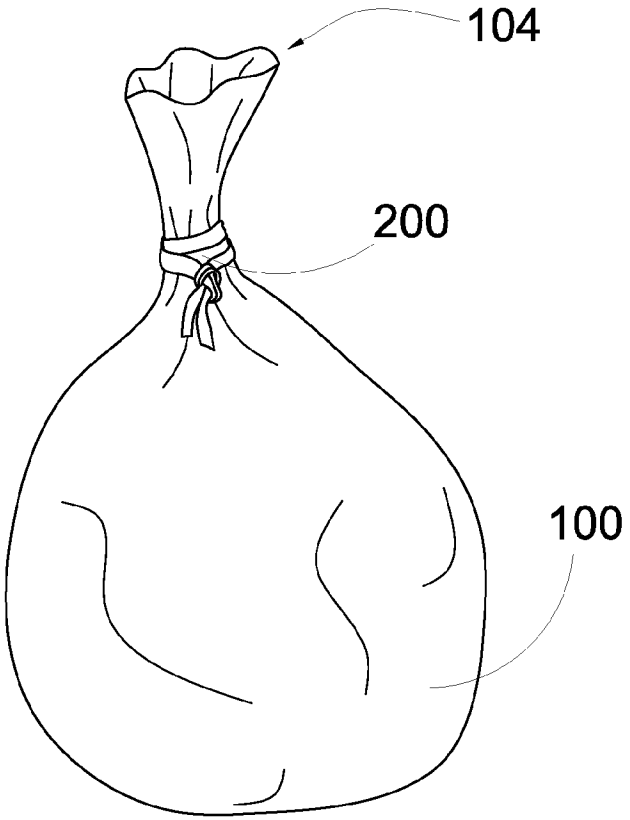
FIG. 4 is a schematic view to show the trash bag tied with the tying element in accordance with the present invention.

In accordance with the principle of the invention, the tying element 200 is provided at the top opening 104 of the bag body 100. Therefore, when the top opening 104 of the bag body 100 is folded back upon itself over the top rim of the trash container 300, the tying element 200 will be located at the outer side of the trash container 300. Therefore, the tying element 200 will remain in clean condition without contacting with the trash disposed in the cavity 103 of the bag body 100. Also, the user is able to easily tear off the tying element 200 from the bag body 100 before the bag body 100 is removed from the trash container 300. Therefore, the user is able to tear off the tying element 200 and to tie the knot at the neck portion of the bag body 100 before taking the bag body 100 out of the trash container 300. FIG. 4 shows the tying element 200 being detached from the bag body 100 and being tied up at the neck portion of the bag body 100 for preventing the trash from being leaked out of the bag body 100.

It will be understood that the tying element 200 can be formed at the bottom side of the bag body 100 or one of the side edges of the bag body 100, where the user can detach the tying element 200 to close the bag body 100.

It will also be understood that the tying element 200 can be made of other material to enhance the strength of the tying element 200, wherein the tying element 200 can be detachably attached to the bag body 100 at one of the top, bottom, and side edges thereof, preferably at the top opening 104. For example, the tying element 200 can be detachably mounted at the top opening 104 of the bag body 100 by adhesive, so that the tying element 200 can be detached from the bag body 100 to close thereof.

Figure 5:
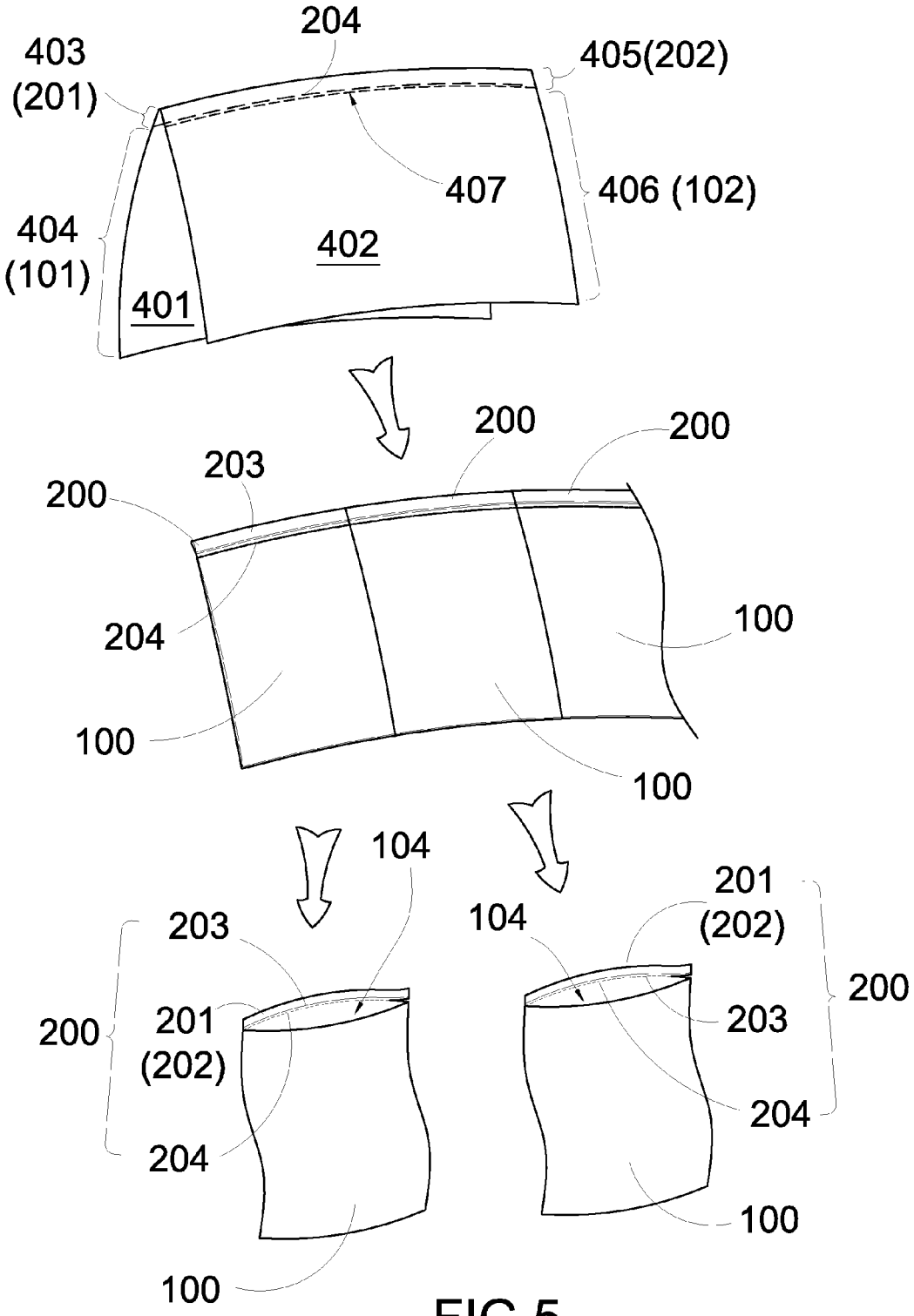
FIG. 5 is a schematic representation of a process for manufacturing the trash bag in accordance with the present invention.

FIG. 5 illustrates a process of manufacturing the plastic trash bag whereby two flat plastic films, i.e. a first plastic film 401 and a second plastic film 402, are formed by conventional trash bag process. In FIG. 5, the first plastic film 401 is overlain with the second plastic film 402. Preferably, a single plastic film is folded in half to form the first and second plastic films 401 and 402. Then, the edges of the first plastic film 401 are sealed with the edges of the second plastic film 402 respectively.

In FIG. 5, the first tying band 201 is formed at the top edge portion 403 of the first plastic film 401 and the first bag sheet 101 is formed at the bottom bag portion 404 of the first plastic film 401. The second tying band 202 is formed at the top edge portion 405 of the second plastic film 402 and the second bag sheet 102 is formed at the bottom bag portion 406 of the second plastic film 402.

The sealing line 203 can be formed along the top edge portions 403 and 405 of the first and second plastic films 401 and 402 to permanently seal the top edge portion 403 of the first plastic film 401 (the first tying band 201) with the top edge portion 405 of the second plastic film 402 (the second tying band 202).

A cut-off line 407 is formed between the top edge portion 405 and the bottom bag portion 406 of the second plastic film 402. Preferably, the edge portion 405 is pre-cut off from the bottom bag portion 406 of the second plastic film 402 along the cut-off line 407 to form the top opening 104 of the bag body 100. Alternatively, the cut-off line 407 can be remained between the top edge portion 405 and the bottom bag portion 406 of the second plastic film 402. Therefore, the user is able to tear off the top edge portion 405 from the bottom bag portion 406 of the second plastic film 402 to form the top opening 104 of the bag body 100.

In accordance with the invention, the perforated line 204 is formed between the top edge portion 403 and the bottom bag portion 404 of the first plastic film 401, so that the tying element is torn along the perforated line 204 to detach the tying element 200 from the bag body 100.

It will be understood that the tying element 200 is formed with the top edge portion 403 of the first plastic film 401 and the top edge portion 405 of the second plastic film 402, to provide the double-layer structure. The bag body 100 is formed with the bottom bag portion 404 of the first plastic film 401 and the bottom bag portion 406 of the second plastic film 402. It will also be understood that the tying element 200 can be manufactured separately, wherein after the bag body 100 is made, the tying element 200 can be detachably mounted at the bag body 100, preferably at the top opening 104, by adhesive.

It will be understood that there is no wasting material of the plastic trash bag through the manufacturing process. It should be noted that the top edge portions 403 and 405 of the first and second plastic films 401 and 402 are used to form the first and second tying bands 201 and 202 of the tying element 200 respectively.

While the embodiments and alternatives of the present invention have been shown and described, it will be apparent to one skilled in the art that various other changes and modifications can be made without departing from the spirit and scope of the present invention.

What is claimed is:

1. A plastic trash bag, comprising:

a bag body being formed of plastic material and having a first bag sheet overlapping with and attaching to a second bag sheet, a cavity being formed between said first and second bag sheets; and a tying element impermanently provided with said bag body, wherein said tying element, having a double-layer structure, comprises a first tying band and a second tying band, which is identical to said first tying band, overlapping with said first tying band to enhance the strength of said tying element, wherein a bottom edge of said first tying band is tearably extended from a top edge of said first bag sheet, wherein a top edge of said first tying band is integrated with a top edge of said second tying band, wherein said tying element further has a sealing line provided therealong to permanently seal said first tying band with said second tying band, wherein said sealing line is extended parallely and is located close to said bottom edges of said first and second tying bands, wherein said first and second tying bands are permanently overlapped that said top edges of said first and second tying bands are integrated with together and said bottom edges of said first and second tying bands are sealed by said sealing line to ensure said double-layer structure of said tying element after said tying element is torn from said bag body, wherein said bottom edge of said second tying band is unattached from said top edge of said second bag sheet to form said top opening of said bag body, wherein when said bottom edge of said first tying band is torn from said top edge of said first bag sheet, said tying element is detached from said bag body to tie a knot at a neck portion of said bag body and to seal said cavity, wherein said bag body is adapted for placing a container that said tying element is located out of said container, wherein said tying element is torn from said bag body without taking said bag body out of said container in order to tie said knot at said bag body.

2. The plastic trash bag of claim 1 wherein said bottom edge of said second tying band is pre-cut off from said top edge of said second bag sheet.

3. The plastic trash bag of claim 2 wherein a perforated line is formed along said top edge of said first bag sheet to tearably extend along said top edge of said first bag sheet with said bottom edge of said first tying band, wherein said first tying band of said tying element is torn along said perforated line to detach said tying element from said bag body.

4. The plastic trash bag of claim 1 wherein a perforated line is formed along said top edge of said first bag sheet to tearably extend along said top edge of said first bag sheet with said bottom edge of said first tying band, wherein said first tying band of said tying element is torn along said perforated line to detach said tying element from said bag body.

* * * * *